United States Patent [19]

Dodge et al.

[11] Patent Number: 5,033,210

[45] Date of Patent: Jul. 23, 1991

[54] SKI BOOT

[75] Inventors: David J. Dodge, Shelburne, Vt.; Mario Mattiuzzo; Marcello Stampacchia, both of Treviso, Italy

[73] Assignee: Lange International S.A.

[21] Appl. No.: 442,575

[22] Filed: Nov. 28, 1989

[30] Foreign Application Priority Data

Jan. 27, 1989 [CH] Switzerland ..... 262/89

[51] Int. Cl.[5] ..... A43B 5/04

[52] U.S. Cl. ..... 36/121; 36/120; 36/117

[58] Field of Search ..... 36/117–121

[56] References Cited

U.S. PATENT DOCUMENTS

| | | | |
|---|---|---|---|
| 4,510,703 | 4/1985 | Eiteljorg | 36/119 |
| 4,577,420 | 3/1986 | Petrini et al. | 36/120 X |
| 4,599,813 | 7/1986 | Sartor | 36/117 |
| 4,601,117 | 7/1986 | Leonardi | 36/120 |
| 4,601,118 | 7/1986 | Zanatta | 36/120 |
| 4,667,424 | 5/1987 | Sartor et al. | 36/120 |
| 4,677,771 | 7/1987 | Arieh et al. | 36/120 |
| 4,685,225 | 8/1987 | Hensler | 36/117 |
| 4,769,930 | 9/1988 | Morell et al. | 36/120 X |
| 4,785,555 | 11/1988 | Sartor | 36/119 |
| 4,875,299 | 10/1989 | Mabbouk et al. | 36/117 |

FOREIGN PATENT DOCUMENTS

| | | | |
|---|---|---|---|
| 0259721 | 3/1988 | European Pat. Off. | 36/117 |
| 0281051 | 9/1988 | European Pat. Off. | 36/117 |
| 0319514 | 6/1989 | European Pat. Off. | 36/120 |
| 8504557 | 10/1985 | World Int. Prop. O. | 36/117 |

*Primary Examiner*—David T. Fidei
*Assistant Examiner*—Ted Kavanaugh
*Attorney, Agent, or Firm*—Kane Dalsimer Sullivan Kurucz Levy Eisele and Richard

[57] ABSTRACT

Boot consisting of a shell (1) and of a shaft (2) articulated on the shell. The shell is provided, at least on one side, with a rigid stop (9) which engages in an indentation (8) of the shaft (2). This stop can occupy different positions to which different flexibilities of the boot correspond.

7 Claims, 4 Drawing Sheets

SKI BOOT

FIELD OF THE INVENTION

The present invention relates to a ski boot which consists of a shell, which surrounds the foot and the heel, and a shaft, which is articulated on the shell and interacts with adjustable stopping means which are mounted on the shell and intended to adjust the bending forwards of the shaft.

PRIOR ART

Boots are known which are provided with an adjustable elastic stop mounted either at the rear (U.S. Pat. No. 3,619,914) or at the front (CH 665 758 and CH 665 634). The elasticity of these stops is modified either by precompression of a spring or by the possibility of greater or lesser deformation allowed to a block of rubber. These stopping means are relatively complex and form a large protuberance at the rear or at the front of the boot. They are, moreover, subject to the formation of ice.

The aim of the present invention is to realize an adjustment of the flexibility of the shaft by means which are simple as possible and do not project very much, by using the inherent elasticity of the material of the boot.

SUMMARY OF THE INVENTION

The ski boot according to the invention is characterized by the fact that the shaft has, at least on one side, an indentation between its point of articulation on the shell and the instep, and that the shell is provided with an adjustable rigid stop arranged in the indentation.

When the leg is bent forwards, the bottom of the indentation first abuts against the rigid stop, then the upper edge of the indentation in its turn abuts against the stop after a greater or lesser bending of the shaft, according to the initial distance between this upper edge of the indentation and the stop. Preferably, a stop is provided on each said of the boot. This construction is particularly suitable for a boot with a shaft in one piece, but it can also be applied to a rear-entry boot with a shaft in two pieces.

The indentation and the stop preferably have a trapezoidal shape and the stop consists of a small trapezoidal metal plate which, moreover, bears laterally against a support surface formed on the shell.

BRIEF DESCRIPTION OF THE DRAWING

The attached drawings represents some embodiments of the boot according to the invention.

DESCRIPTION OF THE PREFERRED EMBODIMENTS

Figure 1:
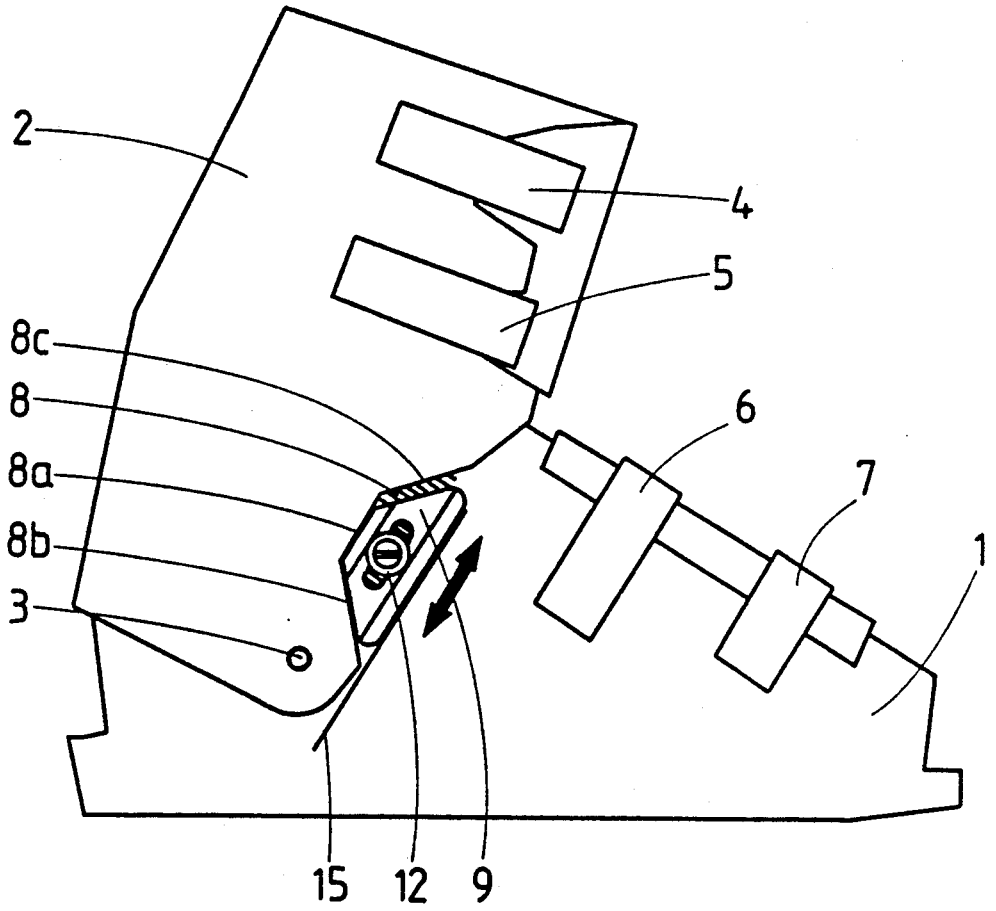
FIG. 1 is a schematic view, from the side, of a boot provided with a stop according to a first embodiment.

The boot represented schematically in FIG. 1 consists of a lower shell part 1 of variable volume, which comprises the sole and surrounds the foot and the heel, and on a shaft 2 in one piece articulated by a pin 3 on the lower shell part 1. The upper part of the shaft is in the form of a collar which can be tightened around the leg by means of tow buckles 4 and 5. The lower shell part is also provided with two buckles 6 and 7 for tightening around the foot. The boot represented is the boot for the right foot.

Between the articulation 3 and the instep, the shaft 2 has an indentation 8 with a trapezodial shape. In this indentation 8 there is arranged a stop 9 which consists of a small metal plate with a trapezoidal shape, the short base of which is parallel to the short base **8*a* of the indentation and the sides of which are respectively parallel to the sides 8*b* and 8*c* of the indentation. In the closed positon of the boot, such as is shown in the drawings, the small plate 9 is in contact with the short base 8*a* of the indentation 8. The small plate 9 has an oblong hole 10 which extends parallel to the hole 10 is passed through by a screw 12 screwed into a nut 13 which is embedded in the internal wall of the shell 1 and the head of which bears against the countersunk area 11 for the fixing of the small plate in the selected position. The rear side of the small plate is, moreover, provided with a serration which interacts with a serration 14 formed on the shell 1. The long base of the small plate 9 furthermore extends along a support face 15 which is perpendicular to the surface of the shell 1** and formed by a local excess thicknes of the shell.

Figure 2:
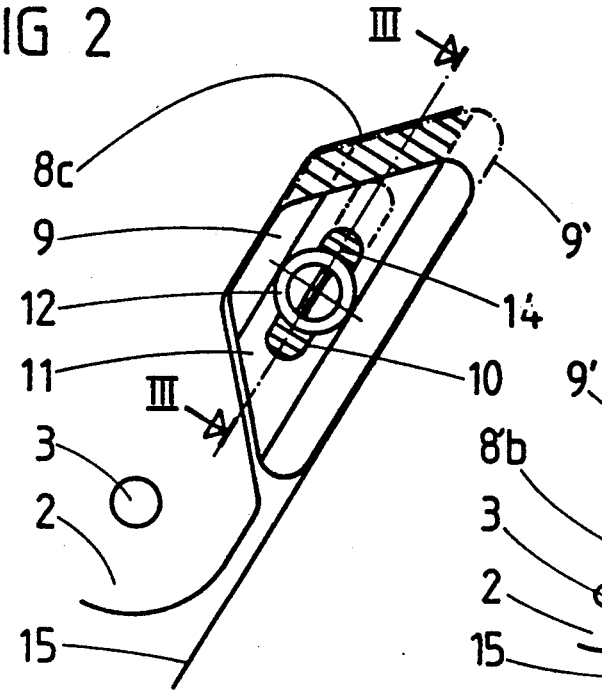
FIG. 2 is a detailed view of the area of the stop.

When the small stop plate 9 is in the position shown in FIG. 1, that is to say the position represented in solid lines in FIG. 2, and a forward bending effort is applied to the shaft 2 of the boot, the latter, by reason of the inherent elasticity of the material of which it consists, bends by bearing with the base **8*a* of its indentation against the stop 9 until the side 8*c* of the indentation in its turn abuts against the stop 9. By modifying the position of the stop 9, the space between the side 8*c* and the stop is modified, that is to say the possibility of bending of the shaft 2 is modified and consequently the flexibility of the boot during skiing. When the small plate is in the position 9', which is represented in dot-dash lines, that is to say in contact with the side 8*c* of the indentation, the shaft 2** no longer has the possibility of bending as described above and the flexibility of the boot is minimal.

The boot is generally to be provided with one moveable stop 9 on each side.

The adjustable stop 9 can be used on a boot which is provided with means of adjustment of the lateral inclination of the shaft such as are described in the patent U.S. Pat. No. 4,334,368. It is to be remembered that these means of adjustment of the lateral inclination are means of adjustment of the lateral inclination are mounted at the articulation 3. The effect of a modification of the lateral inclination of the shaft is to modify the position of the indentation 8. A correction of the position of the stop 9 can be carried out easily if it is desired to retain the same flexibility of the boot.

Figure 3:
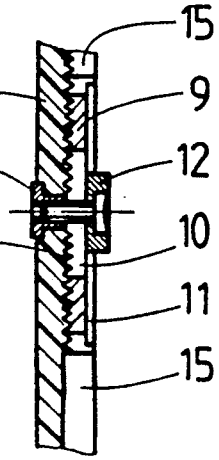
FIG. 3 is a sectional view along III—III of FIG. 2.
Figure 4:
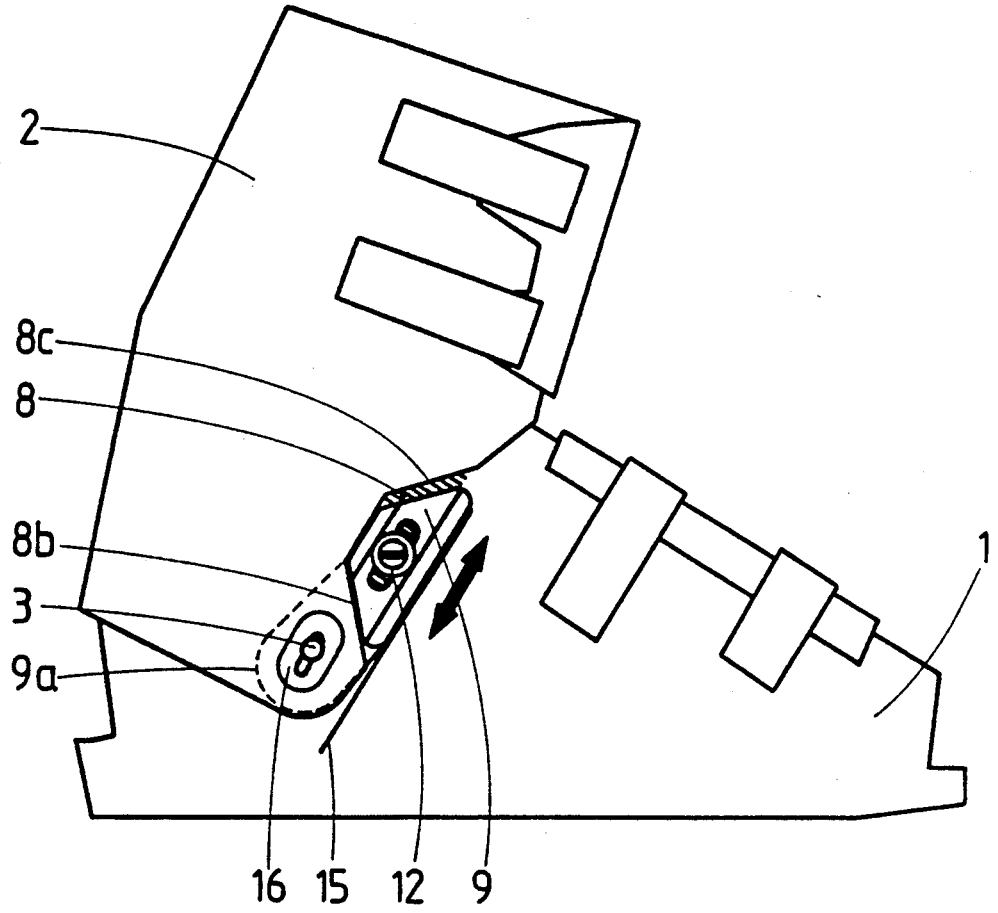
FIG. 4 represents schematically a boot provided with a stop according to a second embodiment.
Figure 5:
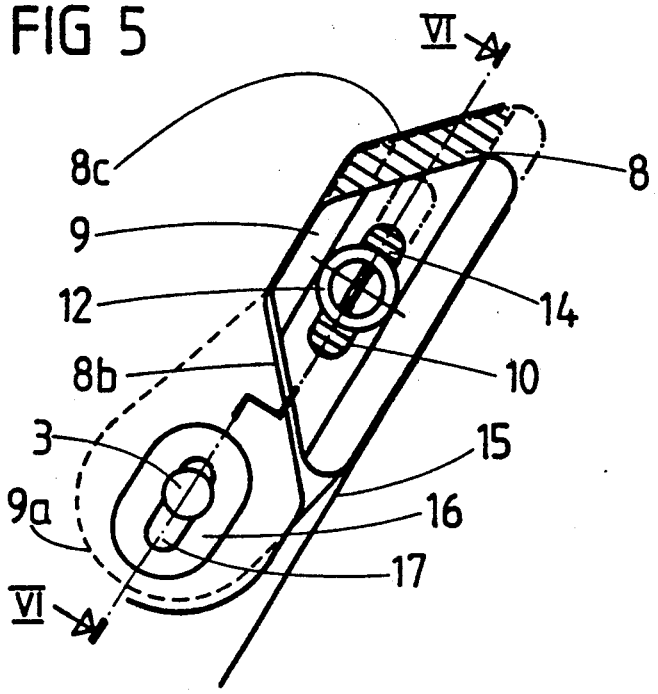
FIG. 5 is a detailed view of this stop.
Figure 6:
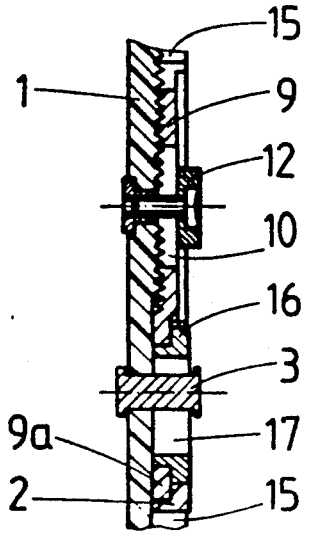
FIG. 6 is a sectional view along VI—VI of FIG. 5.

The adjustment of the lateral inclination of the shaft of the boot can be combined with the stop. An exemplary embodiment is shown in FIGS. 4 to 6. The boot is the same as in the first embodiment. The small plate 9 has an extension 9*a*, which is thinner than the trapezodial part of the small plate 9 and extends between the shaft 2 and the shell 1, around the pin 3 of articulation of the shaft. In the part 9*a* of the small plate, a metal piece 16, which is embedded in the material of the shaft 2, engages. This piece 16 has an oblong slot 17 which is passed through by the pin 3, the diameter of which is equal to the width of the slot 17 which extends parallel to the direction of the hole 10. The displacement of the small plate 9 causes the displacement of the insert 16, that is to say, the displacement of the shaft 2. The displacement of the small plate 9 thus has the effect of modifying the lateral inclination of the shaft 2. In this case, the distance between the side 8*c* of the indentation 8 and the small plate 9 remains constant, so that the small plate 9, thus modified, does not allow the modification of the flexibility of the shaft, at least on this side of the boot, as on the other side of the boot it is possible to mount a stop 9, as shown in FIGS. 1 to 3, so as to permit adjustment of the flexibility of the boot.

Figure 7:
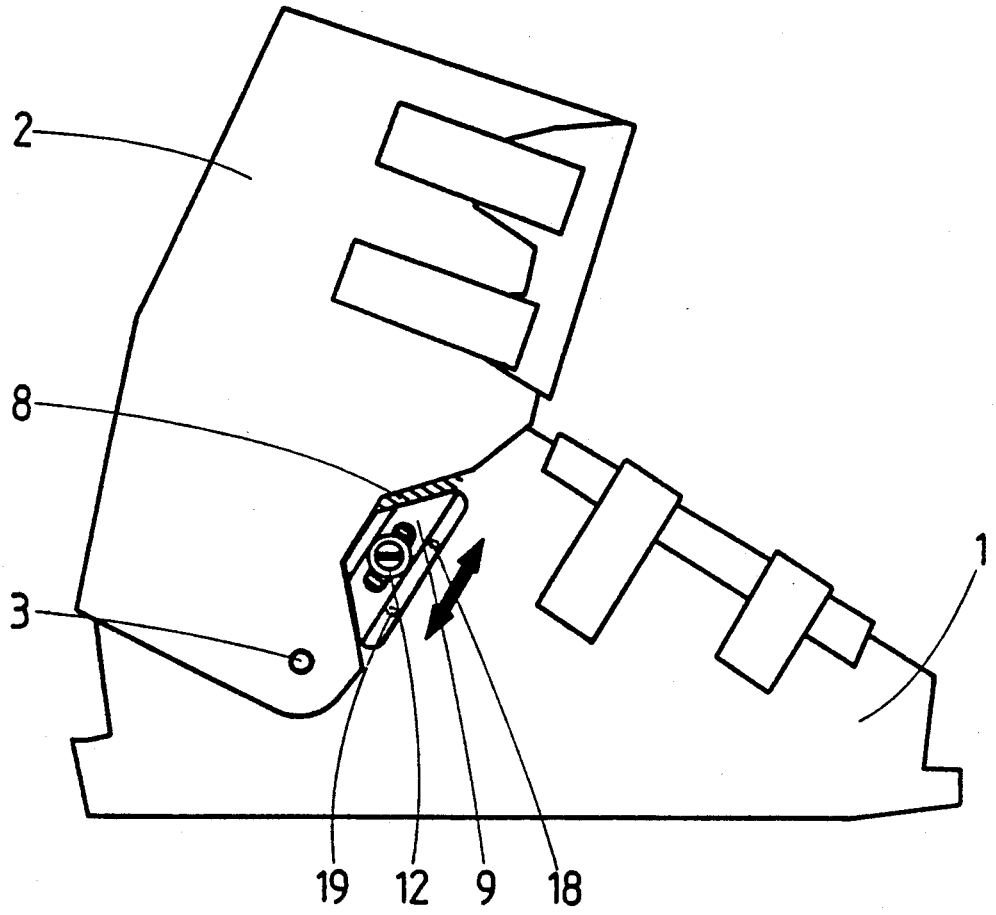
FIG. 7 represents a stop according to a third embodiment.
Figure 8:
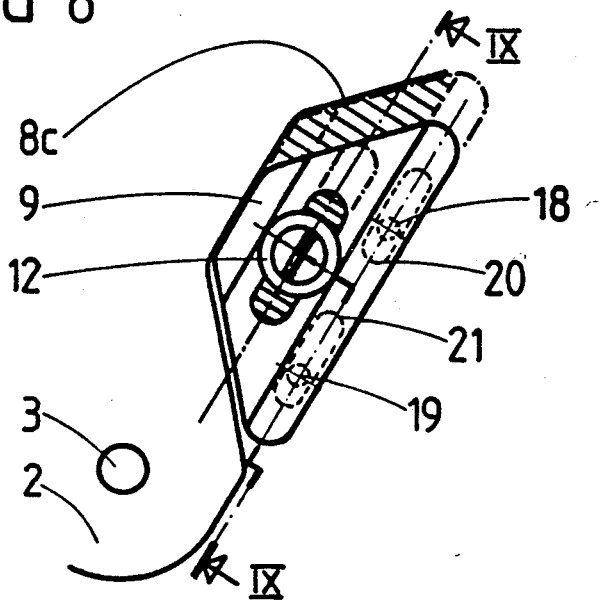
FIG. 8 is a detailed view of the stop according to FIG. 7.
Figure 9:
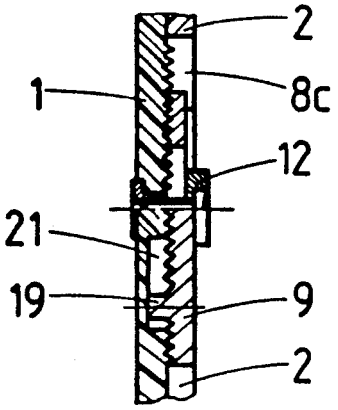
FIG. 9 is a sectional view along IX—IX of FIG. 8.

FIGS. 7, 8 and 9 represent an alternative embodiment of the first embodiment. The small plate 9, instead of bearing laterally against a support surface 15, is provided with two feet 18 and 19, in the form of a stud, which engage respectively in a groove 20 and 21 formed in the thickness of the shell 1. Under the effect of the lateral thrust of the shaft 2 on the small plate 9, the studs 18 and 19 abut against one of the lateral walls of the grooves 20 and 21. Otherwise, this alternative is identical to the first embodiment. The articulation 3 can also be provided with means for adjusting the lateral inclination of the shaft.

Figure 10:
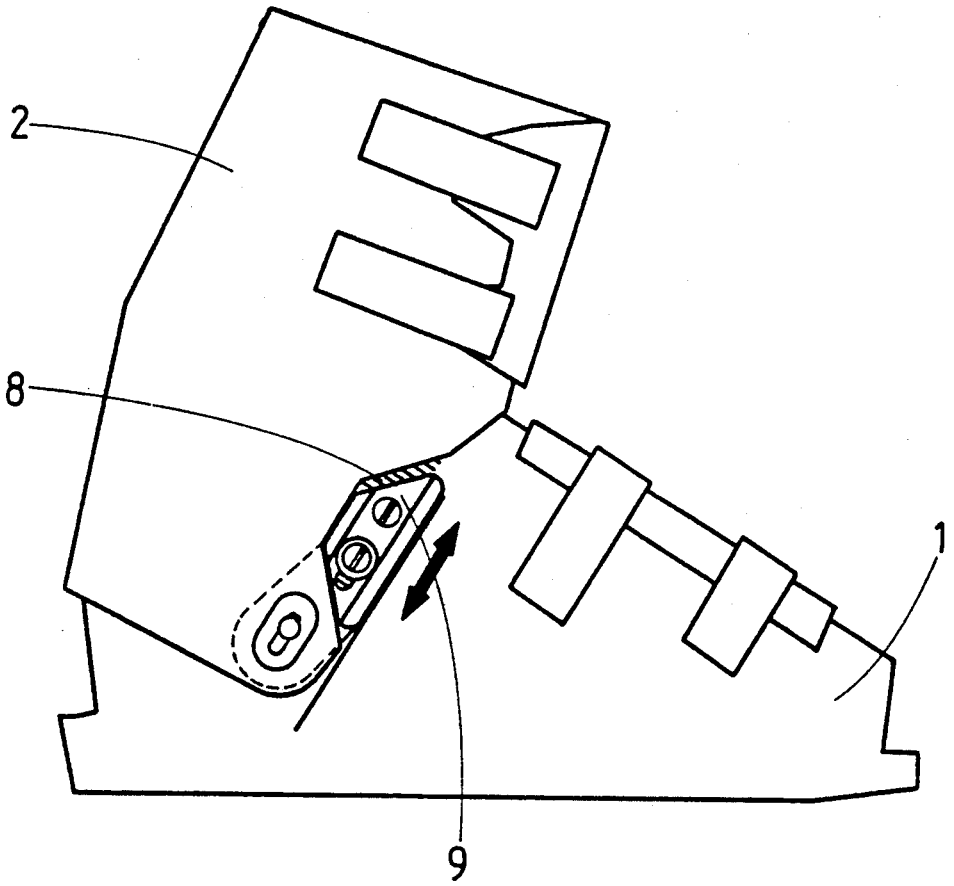
FIG. 10 represents a boot provided with a stop according to a fourth embodiment.
Figure 11:
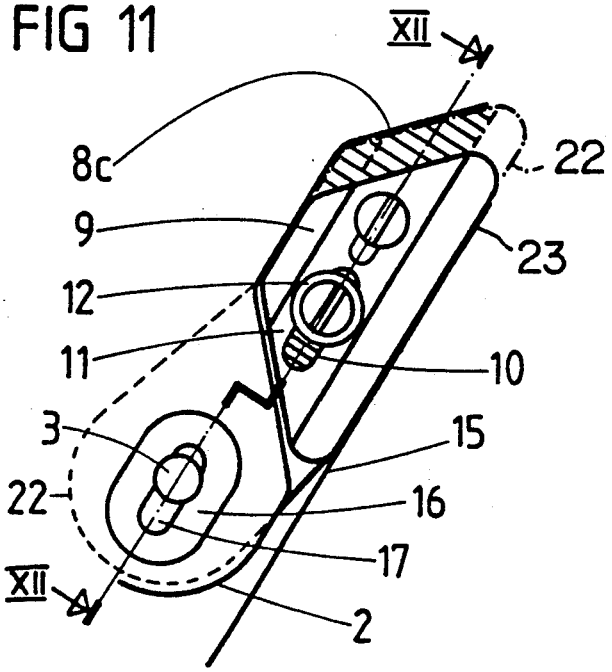
FIG. 11 is a detailed view of this stop.
Figure 12:
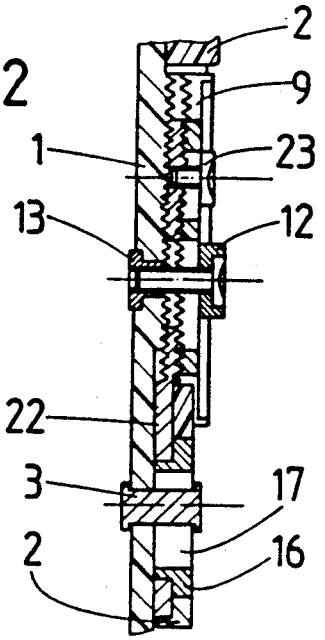
FIG. 12 is a sectional view along XII—XII of FIG. 11.

An alternative embodiment of the second embodiment is represented in FIGS. 10 to 12. This alternative embodiment differs from the second embodiment, represented in FIGS. 4 to 6, in that the adjustment of the flexibility is independent of the adjustment of the lateral inclination of the shaft of the boot. To this end, the serrated small plate 9 is not mounted directly against the shell 1, but on a second serrated small plate 22, which is serrated on both its surfaces. It is this small plate 22 which extends between the shell 1 and the shaft of the boot 2 [sic], around the pin of articulation 3, more precisely around the piece 16 embedded in a cut-out in the shaft 2. The screw 12 and its nut 13 fix simultaneously the small plate 9 and the small plate 22, while the small plate 9 is fixed on the small plate 22 by means of a second screw 23 screwed directly into the small metal plate 22.

In order to modify the flexibility of the boot, it is sufficient to loosen the screw 23 and to move the small plate 9. The small plate 22 remains immobile and the lateral inclination of the shaft is not modified. If, on the other hand, it is desirable to modify this inclination, it is sufficient to loosen the screw 12 and to move the small plate 22, and then to retighten the screw 12. The preceding adjustment of the flexibility is reestablished by then moving the small plate 9.

The small plates 9 and 22 can be made of metal or hard plastic.

Figure 13:
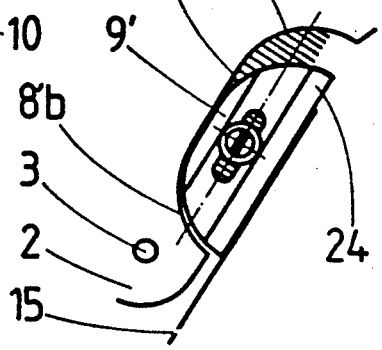
FIG. 13 represents another possible form of the stop.

The small plate 9 and the indentation 8 can have a very great variety of shapes which are capable of satisfying the aim of the invention. Another possible form is represented in FIG. 13. The indentation 8' has a short rectilinear base 8'*a* and two sides 8'*b* and 8'*c* with a circular arc shape. The small plate 9' has a rounded edge 24, the curvature of the upper part of which is considerably greater than the curvature of the part 8'*c* of the indentation. Upon bending, the part 8'*c* bears progressively against the edge 24 of the small plate 9'.

We claim:

1. A ski boot which is comprised of a shell (1), which surrounds the foot and the heel, and of a shaft (2), which is articulated on the shell and interacts with an adjustable rigid stop (9) which is mounted on the shell and intended to adjust the bending forwards of the shaft, wherein the shaft (2) has, at least on one side, an indentation (8) having a peripheral configuration defining a first predetermined contour between its point of articulation (3) on the shell and the instep, and wherein the shell is provided with said adjustable rigid stop having a corresponding second contour of the same geometrical configuration of said first contour arranged in the indentation, the width of the indentation being greater than the stop, said first contour of the indentation extending behind said second contour of the stop in the direction of the instep in such a manner that the resulting clearance permits the upper to bend forwardly over the stop.

2. The ski boot as claimed in claim 1, wherein the indentation (8) and the stop (9) have a trapezoidal shape, flexibility of the boot being determined by the distance between the upper side of the indentation (8*c*) and the corresponding side of the stop.

3. The boot as claimed in claim 2, wherein the stop (9) consists of a small plate which is serrated on its face in contact with the shell and provided with at least one hole (10) which is passed through by a screw for fixing to the shell.

4. The boot as claimed in claim 3, wherein the said small plate (9) has an extension (9*a*), which extends between the shell and the shaft and around a piece (16) which is integral with the shaft and passed through by the pin of articulation (3) of the shaft of the shell for the adjustment of the lateral inclination of the shaft.

5. The boot as claimed in claim 2, wherein the stop consists of a first serrated plate (9) mounted on a second serrated plate (22), which is serrated on both its surfaces and arranged between the first serrated plate and the shell, the second serrated plate extending between the shell and the shaft and around a piece (16) which is integral with the shaft and passed through by the pin of articulation (3) of the shaft on the shell for the adjustment of the lateral inclination of the shaft.

6. The boot as claimed in claim 1, wherein the shell has a support surface (15) against which the stop (9) abuts laterally when it is subjected to the pressure of the shaft.

7. The boot as claimed in claim 3, wherein the lower surface of the serrated small plate (9) is provided with studs (18, 19) which engage in countersunk areas (20, 21) of the shell in order to ensure lateral support of the small plate.

* * * * *